United States Patent [19]

Bippus et al.

[11] 3,964,238

[45] June 22, 1976

[54] DEVICE FOR MANUFACTURING, FILLING AND SEALING CONTAINERS

[75] Inventors: Walter Bippus; Hermann Gernlein, both of Ettlingen; Manfred Horst Simon, Ettlingen-Spessart, Germany

[73] Assignee: Industriewerke Karlsruhe-Augsburg Aktiengesellschaft, Germany

[22] Filed: Nov. 8, 1974

[21] Appl. No.: 522,316

[30] Foreign Application Priority Data

Nov. 9, 1973 Germany ..... 2356055

[52] U.S. Cl. ..... 53/167; 53/180 R; 53/183

[51] Int. Cl.[2] ..... B65B 3/02; B65B 31/00

[58] Field of Search ..... 53/28, 29, 167, 180, 53/183, 184

[56] References Cited

UNITED STATES PATENTS

| | | | |
|---|---|---|---|
| 3,267,639 | 8/1966 | Ollier et al. | 53/184 X |
| 3,820,300 | 6/1974 | Reinecke et al. | 53/167 X |

*Primary Examiner*—Robert L. Spruill
*Attorney, Agent, or Firm*—McGlew and Tuttle

[57] ABSTRACT

The apparatus comprises a tank, having a perforated wall disposed above its bottom, arranged to be flooded with a disinfectant and to have the disinfectant drained therefrom, and arranged to have a laminar flow of germ-free air under pressure directed against the surface of the liquid during draining thereof. A pair of laterally spaced guide rails extend longitudinally through the tank in parallel relation with each other. A plurality of container-working stations and a container-filling station are arranged linearly along the guide rails, each container-working station comprising a pair of mutually displaceable, mirror-reversed mating tool parts, each mounted on a respective guide rail. A pair of webs of thermoplastic material or metal foil, which have already been subjected to a preliminary aseptic treatment, are constantly supplied into the tank for step-by-step displacement along the several container-working stations and the container-filling station. The stations are mounted on the guide rails for adjustment longitudinally thereof to set predetermined stepped distances between these stations and also to permit the two tool parts of each pair to be properly adjusted relative to each other in the vertical direction. The step distance between the stations is simultaneously a function of two parameters, one of which is the desired width of a container and the other of which is the number of containers to be formed simultaneously.

11 Claims, 4 Drawing Figures

DEVICE FOR MANUFACTURING, FILLING AND SEALING CONTAINERS

FIELD AND BACKGROUND OF THE INVENTION

This invention relates to a device for manufacturing containers serving, particularly, to receive aseptic pharmaceuticals having a liquid to pasty consistency, from at least one continuously supplied web of thermoplastic, metal foil, or both, and which has already been subjected to a preliminary aseptic treatment, the manufacturing being effected in a plurality of preferably linearly arranged container-working stations and a container-filling station.

Automatically working filling and closing machines for industrial filling of goods of various consistencies to be packaged have been known for a long time. In the known arrangements, the individual working stations of the filling and closing machines are mounted either on a rotary table or in a straight line, that is in a linear arrangement. As a rule, the goods to be packaged are filled into specifically suitable containers corresponding to the nature and consistency of the goods. Thus, for example, metal or plastic tubes, or tubes of both metal and plastic, are used for receiving toothpastes. For filling tea, thin and porous papers are used which, during the filling operation, are simultaneously formed into a bag shape and provided with an envelope.

In view of the advantages inherent in the use of filling and closing machines, it has become desirable also to package pharmaceuticals, at least pharmaceuticals having a liquid or pasty consistency, into aseptic containers which can be closed by appropriate means. However, in the case of pharmaceuticals, considerably higher demands or standards are made on the manufacture as well as on the maintenance of germ-free conditions for the substances to be packaged, the packing machines and the containers, than would be required in the filling and closing of containers not requiring sterile conditions.

There has already been suggested a method of sterilization of packing receptacles such as, for example, ampoules for receiving drugs, which are formed from a single or a plurality of thermoplastic, aluminum, or the like foil webs and which, after having left the manufacturing station, are filled with the respective medicament, which has also been sterilized, and are sealed. The entire device is sterilized before starting the operation and is maintained under germ-free conditions during service by supplying germ-free air under overpressure. In this procedure, there is a sequence of operations which will now be described.

The foil, serving for manufacturing of the receptacles, is supplied from a delivery reel into a first chamber which is filled with a disinfecting liquid, and is then conveyed into a second chamber, which is separated from the first chamber and which is filled with distilled water. The second chamber is followed by a conduit which also contains distilled water. Thereupon, the distilled water in both the second chamber and the adjacent conduit is drawn off. In place of the distilled water, an already preheated disinfecting liquid is filled into both the second chamber and the conduit, and by this liquid, the foil section extending through the second chamber and the conduit is flooded and thereby sterilized. After an appropriate time, the level of the disinfecting liquid is continuously lowered down to zero while, in conformity with this lowering, germ-free air under overpressure is blown onto the liquid surface. This assures that the foil web, or a corresponding section of the foil web, remains sterilized even after a complete emptying of the second chamber and the adjacent conduit.

SUMMARY OF THE INVENTION

Taking into consideration and utilization the underlying concept of the method just described, the present invention is directed to a device for manufacturing containers serving, particularly, to receive aseptic pharmaceuticals having a liquid to pasty consistency, formed of at least one continuously supplied thermoplastic, metal or thermoplastic and metal foil web which has already been subjected to an aseptic pretreatment in the described manner. This foil web is processed in a plurality of working stations preferably linearly arranged, to form containers suitable for the intended purpose and which are subsequently filled with the liquid to pasty substances in a separate filling station and then are closed or sealed.

To this end, in accordance with the invention, respective pairs of mutually displaceable mirror-reversed mating tool parts form the individual working stations and cooperate, before and during the manufacturing process, with means for maintaining germ-free conditions. These tool parts are displaceably mounted on two elongated guide members which extend longitudinally in spaced parallel relation to each other. The filling station includes one or more filling needles which are mounted on one guide member. The stations are adjustable along the guide members to have a common displacement from each other, hereinafter referred to as the "step length" or "step distance", and which step length or step distance is a function simultaneously of two parameters, one of which is the desired width of a container or package and the other of which is the desired number of containers to be formed simultaneously.

In accordance with a development of the concept of the invention, the displacement of the individual container working stations, as well as the displacement of the needle or needles of the filling station, can be effected in both the horizontal direction and the vertical direction.

In accordance with a further feature of the invention, the displacement of the individual working stations in the horizontal direction is effected by shifting the tools on the guide members which extend parallel to each other. In accordance with another feature of the invention, the guide members preferably comprise profiled strips and, in accordance with this feature, recesses corresponding to the profiled strips are formed on the back of each of the tool parts.

In accordance with a further development of the under-lying inventive concept, the means for maintaining germ-free conditions before and during the manufacturing operation comprise substantially a tub which is adapted to be flooded and drained and which, in accordance with an additional feature of the invention, is filled, in its flooded state, with an agent of liquid consistency serving to disinfect the working stations. However, in its drained or partly drained state, the tub is supplied, in accordance with the invention, with a gaseous fluid such as, for example, a known laminar air flow which is under a small overpressure and which is designed to maintain the disinfected state of the working stations. Finally, the features of the invention are completed by providing that the tub includes a perforated metal sheet, known per se, which is mounted in a horizontal position below the working stations.

The invention has several advantages. Thus, the invention device is relatively simple in construction and operation and, in addition, comprises only a small number of relatively inexpensive component parts.

Aside from the fact that the present invention imparts. for the first time, the teaching of how the measure of displacement or "step length" depends simultaneously on the parameters "package width" and "number of containers", the invention also makes it possible to sterilize even high quality pharmaceuticals, for example, pharmaceuticals having a liquid to pasty consistency, completely and without difficulties. How important and substantial a complete sterility of pharmaceuticals is, becomes evident not in the least from the fact that, in many cases of medical and veterinary practice, such substances are injected intravenously or intramuscularly, which circumstance, in the case of an insufficient sterilization of the packing, for example of a so-called "one-dose package", and the package substance, would lead inevitably to a septicemia, particularly caused by pyogenic viruses.

An object of the invention is to provide an improved device for manufacturing containers serving particularly to receive aseptic pharmaceuticals having a liquid to pasty consistency.

Another object of the invention is to provide such a device in which, both before and during operation, container working and filling stations are maintained in a sterile hygienic condition.

A further object of the invention is to provide such a device in which the working stations are arranged linearly along a pair of elongated guide members extending in laterally spaced parallel relation to each other, and are adjustable on the guide members both longitudinally thereof and vertically thereof.

Another object of the invention is to provide such a device in which at least one foil web of deformable and sealable material is stepped along the working stations during forming, part sealing, filling and complete sealing of the containers.

A further object of the invention is to provide such a device in which the step distance between the stations is simultaneously a function of two parameters, one of which is the desired width of the container package and the other of which is the number of containers to be formed simultaneously.

For an understanding of the principles of the invention, reference is made to the following description of a typical embodiment thereof as illustrated in the accompanying drawings.

DESCRIPTION OF THE PREFERRED EMBODIMENT

Figure 2:
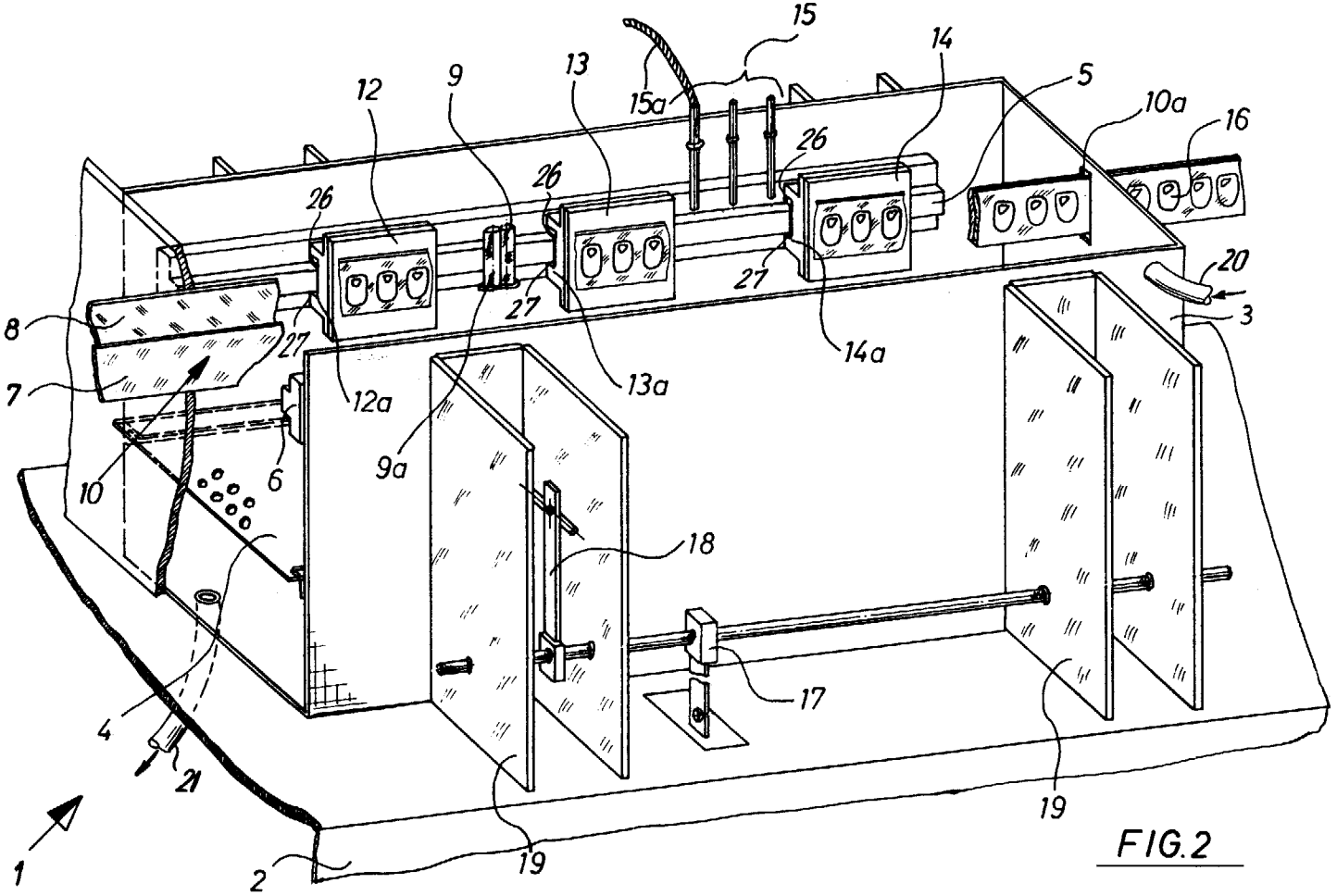
FIG. 2 is a perspective view of a device for manufacturing, filling and closing containers of thermoplastic, metal, or thermoplastic and metal foil webs.
Figure 3:
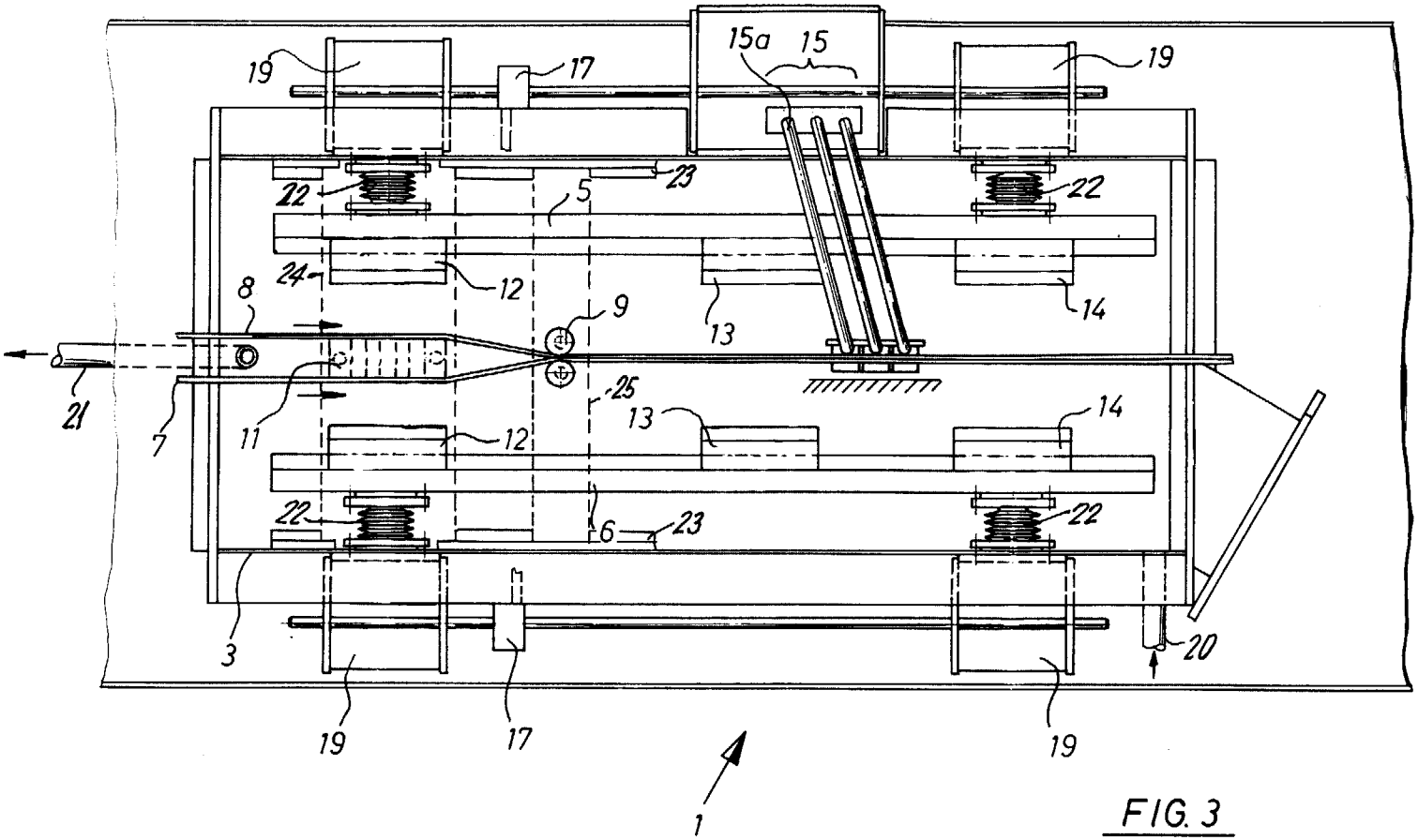
FIG. 3 is a top plan view of the device shown in FIG. 2.
Figure 4:
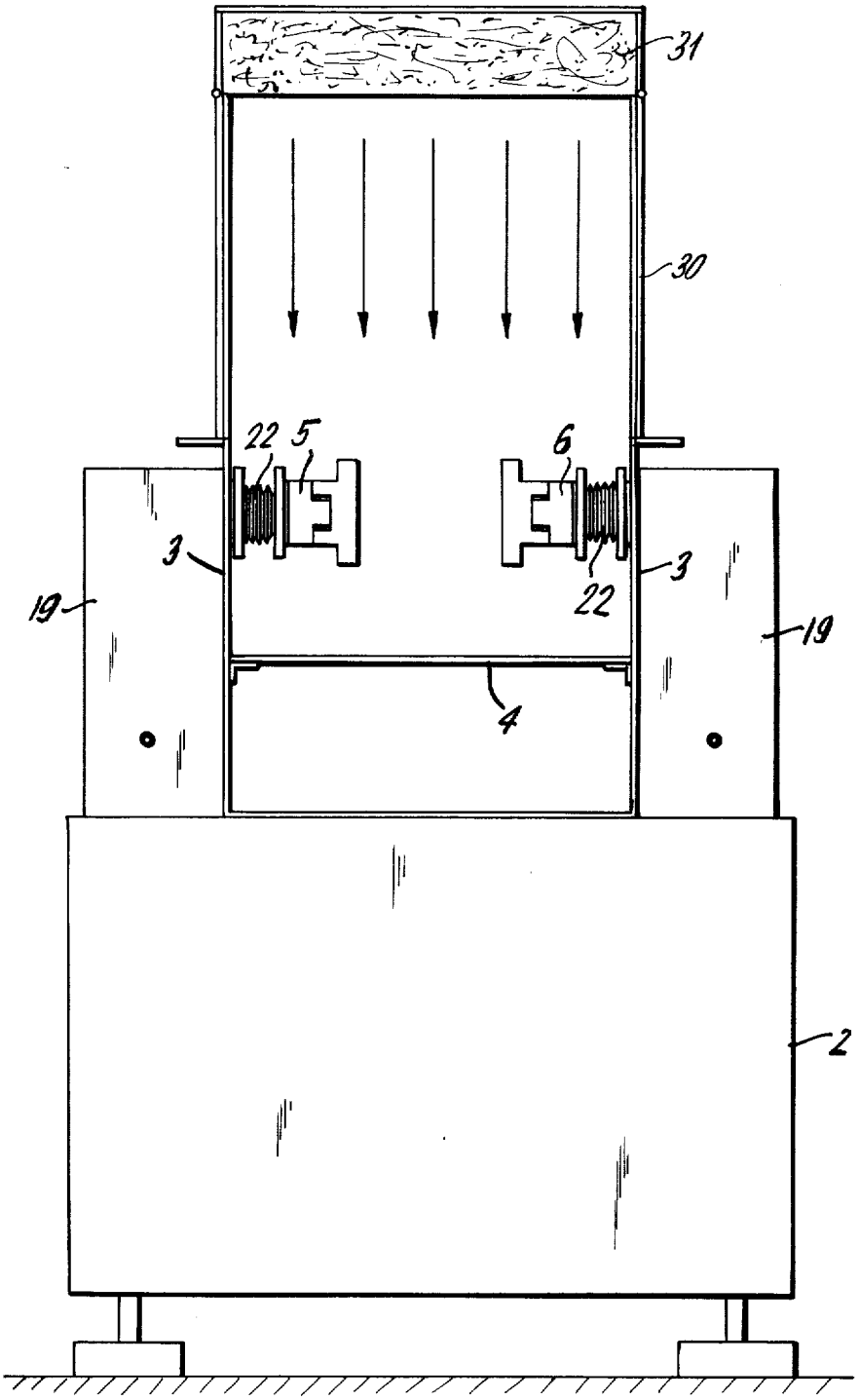
FIG. 4 is an end elevation view of the device.

Referring first to FIGS. 2, 3 and 4, the device, generally designated 1, comprises substantially a machine housing 2 on which is mounted a tub 3 having therein a horizontal perforated metal sheet 4 disposed above its bottom, and also having two guide members or strips 5 and 6 extending therethrough in spaced parallel relation to each other. Two foil webs 7 and 8 are fed into tub 3 at 10, by means of guide means which have not been shown. However, a single web, folded to double thickness, may be used. The foils are formed of thermoplastic material, metal, or both and, prior to their entrance into tub 3, have already been subjected to a preliminary aseptic treatment in a manner forming no part of the present invention.

The forming, partial closing and final closing or sealing of the containers formed in the foil webs 7 and 8 is effected by tool parts 11, 12, 13 and 14 which are linearly arranged, along the path of travel of the foil webs, at predetermined spacings from each other. Tool parts 12, 13 and 14 are mounted on guide strips 5 and 6, and are in the form of respective pairs of mutually displaceable, mirror-reversed mating tool parts. Tool parts 11, which serve to form the interior of the package body, are mounted on plates or bars 24 in turn mounted on ledges or the like 23 extending longitudinally of tub 3 above the guide members or strips 5 and 6. Tool parts 12 cooperate with tool parts 11 to form the exterior of the package body, tool parts 13 serve to pre-seal the sides and bottoms of the package body, and tool parts 14 serve to seal the top filling openings of the package body.

A pair of cooperating rollers 9 and **9*a* are mounted on a bar or plate 25 supported on the ledges 23 and serve to press foil webs 7 and 8 into contact, rollers 9 and 9*a* being mounted between tool parts 11 and 12 and tool parts 13. It will be noted that tool parts 11 and 12** are located in lateral alignment with each other.

The filling station is generally designated 15, and may be equipped with one or a plurality of filling needles, the filling station being mounted on for vertical displacement on an arm supported on tub 3. After the forming, filling and closing operations have been terminated, the package bodies or containers, for example as indicated at 16 and which are still connected to the foil webs, exit from tub 3 at **10*a***.

Foil webs 7 and 8, which are continuously fed into device 1 as indicated at 10, have already been sterilized in a preliminary stage of treatment which forms no part of the present invention. Before the foil webs 7 and 8 which are thus pre-treated are fed into device 1 for further processing and filling, it is absolutely necessary also to sterilize the forming and filling tools. This is substantially accomplished by flooding tub 3 with a known chemical disinfectant of liquid consistency, or by using a disinfectant which has been subjected to a sterilizing and filtering process.

If there is used a chemical disinfectant, in the liquid state, which, besides may or may not be heated, the disinfectant, as a rule, kills surely only certain categories of bacteria. However, the sterilization degree obtainable with such agents is generally satisfactory from the standpoint of the requirements of pharmaceutical practice, since the manipulation with such an agent is easy and relatively inexpensive. The process of sterilizing and filtering, on the other hand, is optimal because it is based on certain knowledge about the conditions required for the sterilization of the liquid to be filled into tub 3, and the filtered liquid is not only sterile but also is free from killed bacteria.

The tub 3 may be filled through a fluid inlet 20 and may be drained through a fluid outlet 21. After an appropriate period of dwell of the working and filling tools in the disinfecting bath, the bath is drained through perforated sheet 4 with the disinfecting agent flowing out through outlet 21. Simultaneously, and in the same proportion as the disinfecting agent is drained, germ-free air, in the form of a so-called laminar air flow, is blown on the lowering surface of the liquid to ensure sterility also during operation of device 1. As best seen in FIG. 4, this air flow may be effected through a conduit or the like formed by partition walls 30 and positioned above tub 3, the walls 30 extending upwardly from the sides and ends of tub 3, and a device 31, for producing a laminar flow of sterile air being provided at the upper end of the conduit. The laminar air flow is indicated by the arrows in FIG. 4.

In filling station 15, the substance to be received in the individual containers is filled into these containers, also in the sterilized state. Filling station 15 may be equipped with either one or a plurality of filling needles to which the substance to be filled into the containers is supplied through flexible conduits such as flexible tubes 15*a*. The number of filling needles depends on the number of plastic, metal or plastic and metal package units or containers to be filled simultaneously.

Figure 1:
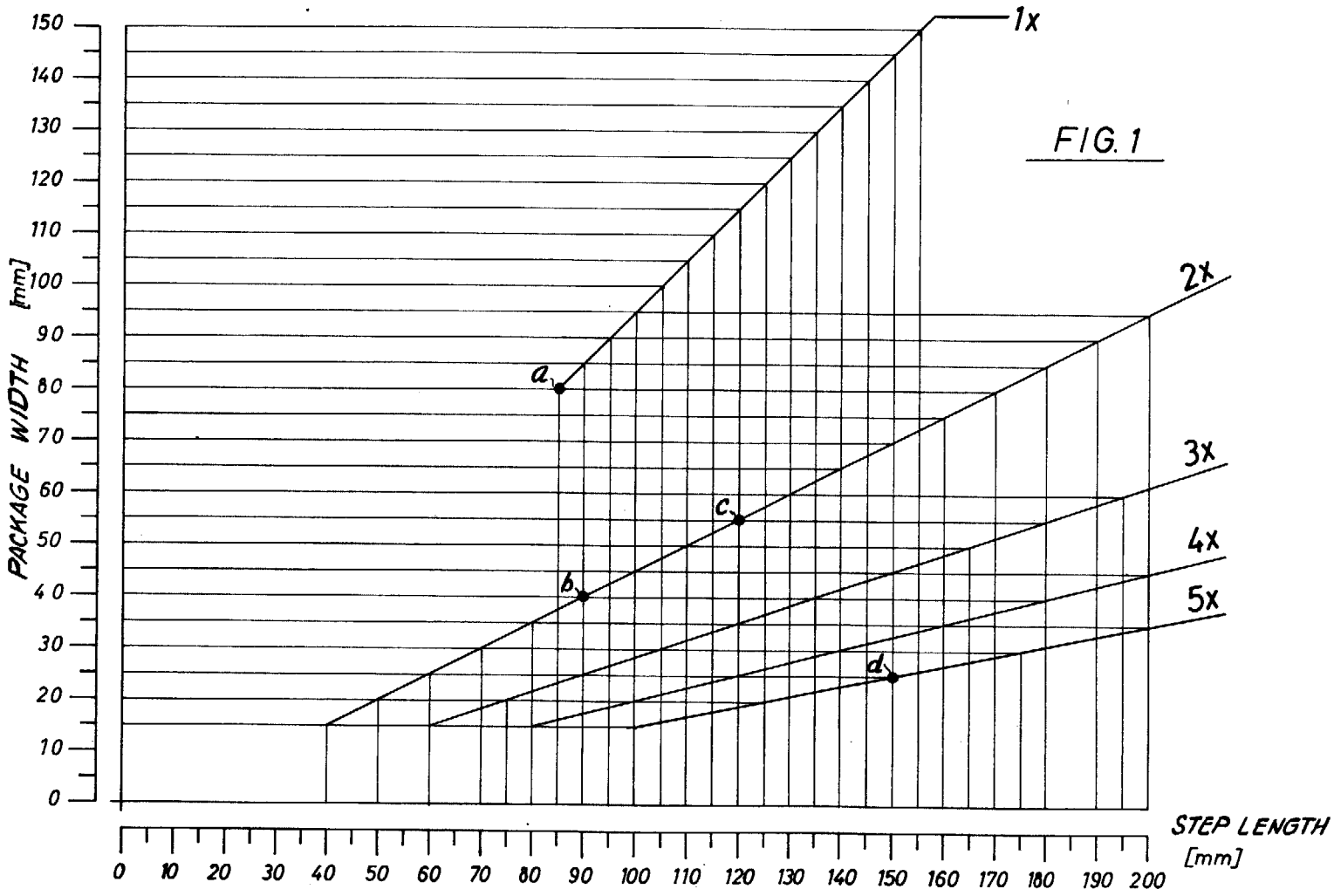
FIG. 1 is a diagram showing the package width as well as the number of containers to be simultaneously formed, as a function of the step length.

As illustrated in the chart of FIG. 1, there is interrelation between the number of the package units or containers to be manufactured simultaneously and filled, and the package width, on the one hand, and the respective step length, to be adjusted for this purpose, on the other hand. Referring to FIG. 1, the reference characters 1X – 5X indicate the number of package units or individual containers obtained with a certain package width and a predetermined step length. This may be illustrated by the following examples:

a. With a step length of 85 mm and a package width of 80 mm, a single package unit is obtained as indicated by the line 1X.

b. With a step length of 90 mm and a package width of 40 mm, two package units are obtained as indicated by the line 2X.

c. With a step length of 120 mm and a package width of 55 mm, two package units also are obtained, as indicated by the line 2X.

d. In contrast to the foregoing, with a step length of 150 mm and a package width of 25 mm, a total of five package units or containers is obtained as indicated by the line 5X.

By utilizing the graph shown in FIG. 1, the dependence of the package width on the step length, corresponding to the intermittent advance of the foil webs from one tool to the next tool or, inversely, the dependence of the step length on the package width, may be determined in a very simple manner.

In practice, the diagram of FIG. 1 can be used, in each instance, for adjusting the step length, that is, the longitudinal displacement or spacing between the working and filling tools in the horizontal plane, which results from, or which may be determined easily as a function of, the known or desired width of the package or of the desired number of package units to be simultaneously formed and filled.

For opening and closing forming tools 12, 13 and 14, a drive 17, 18 is provided at each side of the housing 4, and mounted on channel brackets 19 which are secured to the machine housing 2. The drive receives its motion from a motorcontrolled cam-type mechanism which has not been illustrated. As should be clear from FIGS. 2 and 3, each drive is connected to a respective one of the guide members 5 or 6 and, within the tub 3, is sealed within a flexible bellows or the like 22.

Each working tool station 12, 13, 14 is spaced from the adjacent station by a distance corresponding to two working strokes. While guide rollers 9, 9*a* are located between tools 12 and 13, cooling tools or equipments may be provided between tools 13 and 14 to protect the filled substance against thermal radiation during the sealing operation, although such cooling tools or equipments have not been shown in the drawing.

In order that the mutually displaceable mirror-reversed mating tool parts may be positioned so that they are exactly matched, it is necessary to provide the possibility to displace the tool parts in both the horizontal and vertical directions. Such displacement is effected manually, since frequently only a small correction of, for example, 0.5 to 1.5 mm is necessary. For the horizontal displacement, the tool parts are manually shifted on guide rails 5 and 6. In order to provide for vertical adjustment or displacement, the tool parts are supported on guide rails 5 and 6 by upper and lower spacers or shims 26 and 27. These spacers or shims may be exchanged in order to obtain a vertical displacement of the associated tool part up or down, for example, by 0.5 to 1.5 mm.

The spacers or shims 26 and 27 are located in the recesses on the backs of the tool parts and, normally, both the upper shim 26 and the lower shim 27 have the same thickness. However, if, for example, one of the tool parts 12 is to be displaced upwardly by 1 mm relative to the other tool part 12, the upper and lower shims or spacers having equal thicknesses of, for example 5 mm are removed and are replaced by other spacers or shims. In such case, the upper spacer or shim would have a thickness of 4 mm and the lower spacer or shim would have a thickness of 6 mm. Due to the difference in thickness of the two spacers or shims, the respective tool part 12 is vertically displaced relative to the other tool part 12 through a distance of 1 mm. The respective recesses in the back surfaces of the tool parts 12, 13 and 14 are indicated at 12*a*, 13*a* and 14*a*, respectively, as being essentially in the form of channels.

In the specific example shown in FIG. 2, the tool parts 12, 13 and 14 are illustrated as being designed to form simultaneously three containers. In the event the numbers of containers to be formed simultaneously is to be changed, the tool parts are removed and are replaced by other tool parts having the appropriate number of cavities or the like in their mating surfaces in accordance with the newly selected number of containers to be formed simultaneously. The tool parts, of course, are in the nature of forming dies, such as, for example, sealing dies or the like.

While a specific embodiment of the invention has been shown and described in detail to illustrate the application of the principles of the invention, it will be understood that the invention may be embodied otherwise without departing from such principles.

What is claimed is:

1. In a device for manufacturing, filling and sealing containers serving, particularly, to receive aseptic pharmaceuticals having a liquid to pasty consistency, from two constantly parallel facing supplied webs, of deformable and sealable foil material, which has already been subjected to a preliminary aseptic treatment, in a plurality of preferably linearly arranged container-working stations and a container-filling station, the improvement comprising, in combination, respective pairs of mutually displaceable, mirror-reversed mating tool parts at each container-working station respectively operable on both webs of the foil material, in sequence, to form therefrom a predetermined number of containers simultaneously in advance of said filling station, to simultaneously seal the side and bottom edges of said predetermined number of containers in advance of said filling station, and to simultaneously sealingly close said predetermined number of containers after simultaneous filling thereof at said filling station; means maintaining germ-free conditions in said device; said tool parts cooperating with said means before and during the manufacturing process; and a pair of elongated guide members extending in laterally spaced parallel relation to each other longitudinally of the direction of linear arrangement of said stations; said pairs of tool parts being mounted on said guide members for adjustment therealong; said filling station including a number of container-filling needles, equal to said predetermined number of containers, mounted on said device; both said webs being stepped longitudinally of all said stations for forming, filling and sealing said containers; the step distance between said stations being simultaneously a function of two parameters, one of which is the desired width of an individual container and the other of which is the number of containers to be formed simultaneously.

2. In a device for manufacturing containers, the improvement claimed in claim 1, in which said container-working stations and each container-filling needle are displaceable both longitudinally and vertically relative to said guide members.

3. In a device for manufacturing containers, the improvement claimed in claim 2, in which said container-working stations are displaceable horizontally on said guide members.

4. In a device for manufacturing containers, the improvement claimed in claim 1, in which said guide members comprise profiled strips.

5. In a device for manufacturing containers, the improvement claimed in claim 4, in which each tool part is formed, on its rear surface, with a recess corresponding to said profiled strips.

6. In a device for manufacturing containers, the improvement claimed in claim 1, in which said means maintaining germ-free conditions before and during the manufacturing process comprises a tub having said guide members disposed therein; means operable to flood said tub; and means operable to drain said tub.

7. In a device for manufacturing containers, the improvement claimed in claim 6, in which said means operable to flood said tub is operable to supply said tub with an agent, of liquid consistency, operable to disinfect said working stations.

8. In a device for manufacturing containers, the improvement claimed in claim 7, including means operatively associated with said tub and operable, in the drained and partly drained state of said tub, to provide a laminar air flow under a small overpressure to the surface of said agent to maintain said working stations in a disinfected state.

9. In a device for manufacturing containers, the improvement claimed in claim 7, including a horizontally oriented perforated metal sheet mounted in said tub below said working stations.

10. In a device for manufacturing containers, the improvement claimed in claim 1, in which said guide members are mounted for horizontal displacement toward and away from each other; and means operable to displace said guide members toward each other to engage said mating tool parts and to move said guide members away from each other to disengage said mating tool parts.

11. In a device for manufacturing containers, the improvement claimed in claim 5, including respective interchangeable spacers in said recesses engageable with said profile strips to effect vertical alignment between the mating tool parts of each pair.

* * * * *